US007360473B1

(12) United States Patent
Holt

(10) Patent No.: US 7,360,473 B1
(45) Date of Patent: Apr. 22, 2008

(54) SHINGLE REMOVAL TOOL

(76) Inventor: Terrill Holt, 271B Main St., Somersworth, NH (US) 03878

( * ) Notice: Subject to any disclaimer, the term of this patent is extended or adjusted under 35 U.S.C. 154(b) by 0 days.

(21) Appl. No.: 11/678,588

(22) Filed: Feb. 24, 2007

(51) Int. Cl.
*E04D 15/00* (2006.01)

(52) U.S. Cl. ..... 81/45

(58) Field of Classification Search ..... 81/45, 81/46; 7/114–116; 254/21, 25, 131.5; D8/6
See application file for complete search history.

(56) References Cited

U.S. PATENT DOCUMENTS

| | | | | |
|---|---|---|---|---|
| 730,781 | A * | 6/1903 | Mitchell | 81/45 |
| 3,074,694 | A * | 1/1963 | Erickson, Jr. | 254/104 |
| 3,251,629 | A * | 5/1966 | Cawley | 299/37.5 |
| 3,563,608 | A * | 2/1971 | Crispino | 299/36.1 |
| 3,779,605 | A * | 12/1973 | Nieman | 299/37.1 |
| 3,987,827 | A * | 10/1976 | Mills | 81/45 |
| 4,177,864 | A * | 12/1979 | Donnini | 172/371 |
| 5,495,781 | A | 3/1996 | Wirth | |
| D392,867 | S | 3/1998 | Gracey et al. | |
| 5,800,021 | A * | 9/1998 | Derr | 299/37.1 |
| 5,813,295 | A * | 9/1998 | Jensen, Jr. | 81/45 |
| 5,906,145 | A * | 5/1999 | Shepherd | 81/45 |
| 6,105,469 | A | 8/2000 | Gracy | |
| 6,125,720 | A | 10/2000 | Gohman | |
| D439,126 | S | 3/2001 | Gohman | |
| 2002/0053261 | A1* | 5/2002 | Arturo et al. | 81/45 |
| 2006/0191378 | A1* | 8/2006 | Linscott | 81/45 |

* cited by examiner

*Primary Examiner*—Joseph J. Hail, III
*Assistant Examiner*—Bryan R Muller
(74) *Attorney, Agent, or Firm*—Phillip E. Decker; Mesmer & Deleault, PLLC

(57) ABSTRACT

A shingle removal tool having a head; at least two teeth coupled with the head, the teeth being spaced apart and parallel to each other, each tooth having an acute angle near an end of the tooth that is opposite the head for engaging shingles; and a barb coupled with the head perpendicular to the teeth, whereby a user can thrust the tool beneath a layer of shingles, the teeth lifting the shingles off a subsurface and free of nails, enabling the user to move the shingles away from the surface like a shovel and to also move shingles by using the barb. Several types of handles or bit shanks can be attached.

20 Claims, 7 Drawing Sheets

SHINGLE REMOVAL TOOL

BACKGROUND

1. Field of the Invention

The invention is related to devices adapted to remove roof or wall shingles.

2. Description of the Related Art

Removing shingles from a roof or wall is a very slow and labor-intensive task. The most common tool used for removing shingles is a serrated shovel, such as the one disclosed in U.S. Pat. No. 5,813,295 that issued to Jensen, and which is not admitted to being prior art by its mention in this Background section. Jenson discloses a roofing material removal tool having a heavy weighted had with an obtuse bend. The head has a blade edge having spaced detents separated from each other by angular collection notch. The user thrusts the point of the shovel under the shingles until nails contacting the serrations stop the shovel. Then the user pries up the nails and starts again. Since there are many nails holding the shingles, it takes a great deal of time to remove shingles from a roof or wall due to continuous starting and stopping.

A similar solution that has been tried is disclosed in U.S. Pat. No. 6,105,469, that issued to Gracy, and which is not admitted to being prior art by its mention in this Background section. The Gracy reference discloses a tool that has a wedge-shaped wing disposed on each side of the head and perpendicular to the head. The head is planar, except for the teeth, which have tapered ends. This device is also designed to catch nails, and will stop the tool, forcing the user to pry up the nails. This device has the same disadvantages of the Jenson reference.

Yet another solution that has been tried is disclosed in U.S. Pat. No. 6,125,720, that issued to Gohman, and which is not admitted to being prior art by its mention in this Background section. Gohman discloses a similar solution, except the device uses two tiers of teeth, large ones, and small ones between the large ones. Each of the fingers is rounded to present smooth tips for inserting under roofing material. This device is still intended to contact roofing nails and come to a stop, and therefore has the same disadvantages of the previously-mentioned references.

Also, when using these devices, many shingles will be loosened, but remain adhered to the roof or wall by nails in connecting adjacent shingles. The serrated shovel does not have any features that are useful for separating them.

What is needed, therefore, is a shingle removal tool that lifts shingles faster without stopping when it contacts a nail, moves them downhill more efficiently, and facilitates moving them off a roof.

SUMMARY

An invention that satisfies the need to lifts shingles faster, moves them downhill more efficiently, and facilitates moving them off a roof comprises a head; a plurality of teeth coupled with the head, the teeth being in a spaced relationship parallel to each other, and perpendicular to the head, each tooth having an acute angle near an end of the tooth that is opposite the head for engaging shingles; and a barb coupled with the head perpendicular to the teeth. These and other features, aspects, and advantages of the present invention will become better understood with regard to the following drawings, description, and claims.

DRAWINGS

DESCRIPTION

The invention is a shingle removal tool or apparatus that satisfies the need to lift shingles faster, move them downhill more efficiently, and facilitate moving them off a roof. In one embodiment, the invention comprises a head; a plurality of teeth coupled with the head, the teeth being in a spaced relationship parallel to each other, each tooth having an acute angle near an end of the tooth that is opposite the head for engaging shingles; and a barb coupled with the head perpendicular to the teeth. Several types of handles could be attached.

Figure 1:
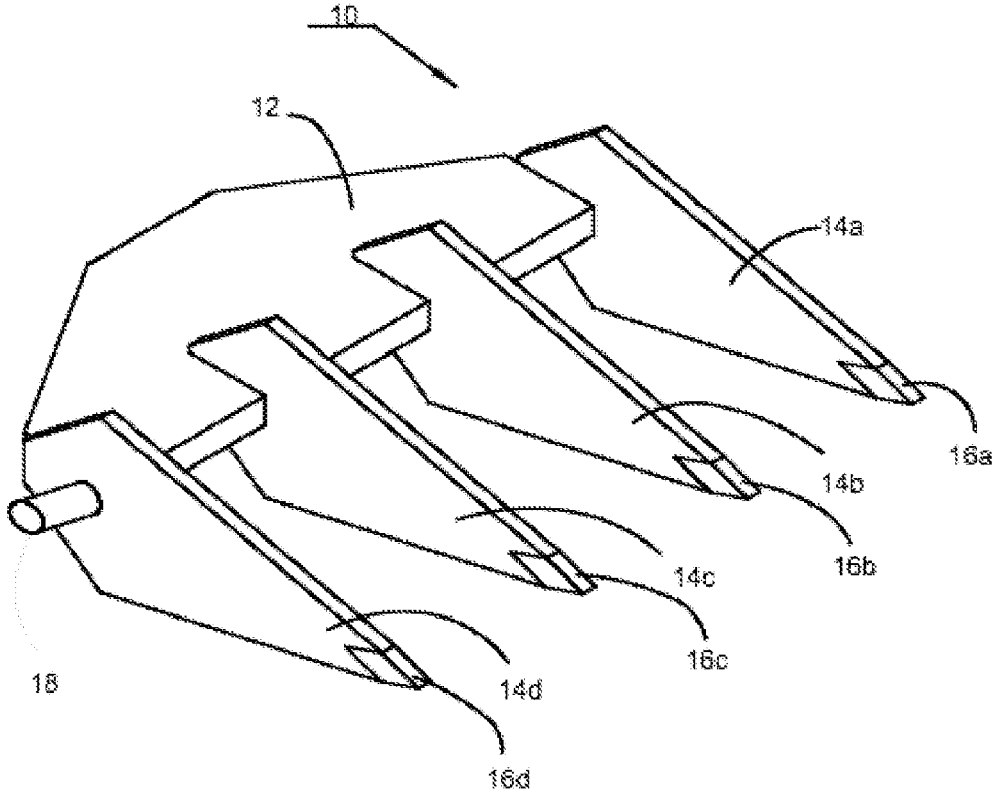
FIG. 1 is an orthogonal view of a tool according to the preferred embodiment of the present invention.

Turning to FIG. 1, the shingle removal tool 10 comprises a head 12, a plurality of teeth 14*a*, 14*b*, 14*c*, 14*d*, and at least one barb 18. The teeth are in a spaced relationship to each other, and are parallel to teach other. Each tooth has an acute angle near an end of the tooth that is opposite the head 12. The acute angle end is used to engage the shingles.

In one embodiment, a hardened tip 16*a*, 16*b*, 16*c*, 16*d* can be coupled with the acute angle end of the teeth 14*a*, 14*b*, 14*c*, 14*d*. The hardened tip can be a carbide tip, or other hardened structure added to the teeth or formed integrally with the teeth by, for example, cold working, case hardening, or heat treating. If the tips are added, then the acute angle may or may not extend to the tip of the teeth. It is foreseeable that the teeth end in a notch for receiving a hardened tip. This is why the teeth's acute angle is defined as near the end of the teeth, instead of at the end of the teeth. Preferably, the teeth are arrowhead-shaped, but it is not necessary. Four teeth 14*a*, 14*b*, 14*c*, 14*d* are shown in the drawings, but any number could be used provided there are at least two teeth.

The barb 18 is coupled to the head 12 perpendicular to the plane of the teeth 14*a*, 14*b*, 14*c*, and 14*d*. One or more barbs 18 can be provided.

The head 12 is shown as being made from a flat plate material. This is preferred, but not required. If the head 12 is planar or plate-like, then the teeth are preferably coupled perpendicular to the plane of the head 12. The head 12 can be made of any suitably strong and rigid material. However, acceptable materials include, without limitation, mild steel, carbon steel, alloy steel, tungsten, silicon carbide, titanium, and fiberglass.

Figure 2:
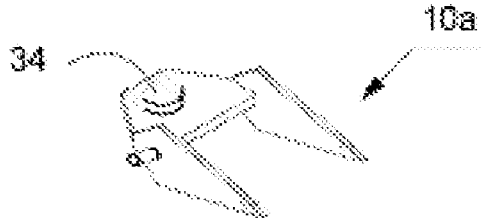
FIG. 2 is an orthogonal view of a tool having two teeth.
Figure 3:
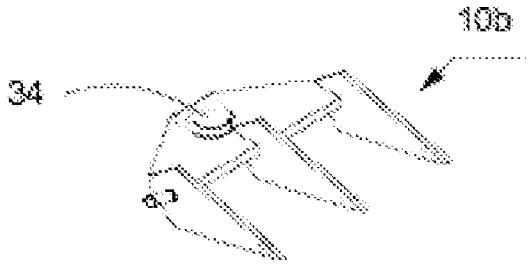
FIG. 3 is an orthogonal view of a tool having three teeth.

FIG. 2 shows another embodiment of the tool 10*a* shown in FIG. 1, having two teeth. A recess 34 is shown at an end of the head opposite the teeth that is designed to be operatively coupled with, and receive, a handle. FIG. 3 shows another embodiment of the tool 10*b* having three teeth. FIG.

Figure 4:
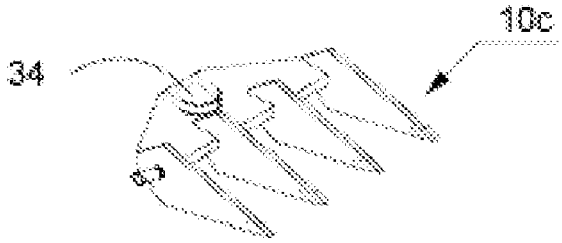
FIG. 4 is an orthogonal view of a tool having four teeth.
Figure 5:
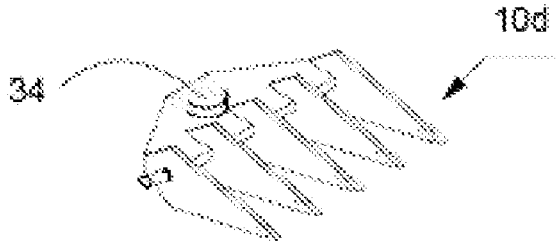
FIG. 5 is an orthogonal view of a tool having five teeth.

4 shows the same embodiment of the tool 10*c* shown in FIG. 1, except that FIG. 4 shows the recess 34. FIG. 5 shows another embodiment of the tool 10*d* having five teeth.

Figure 6:
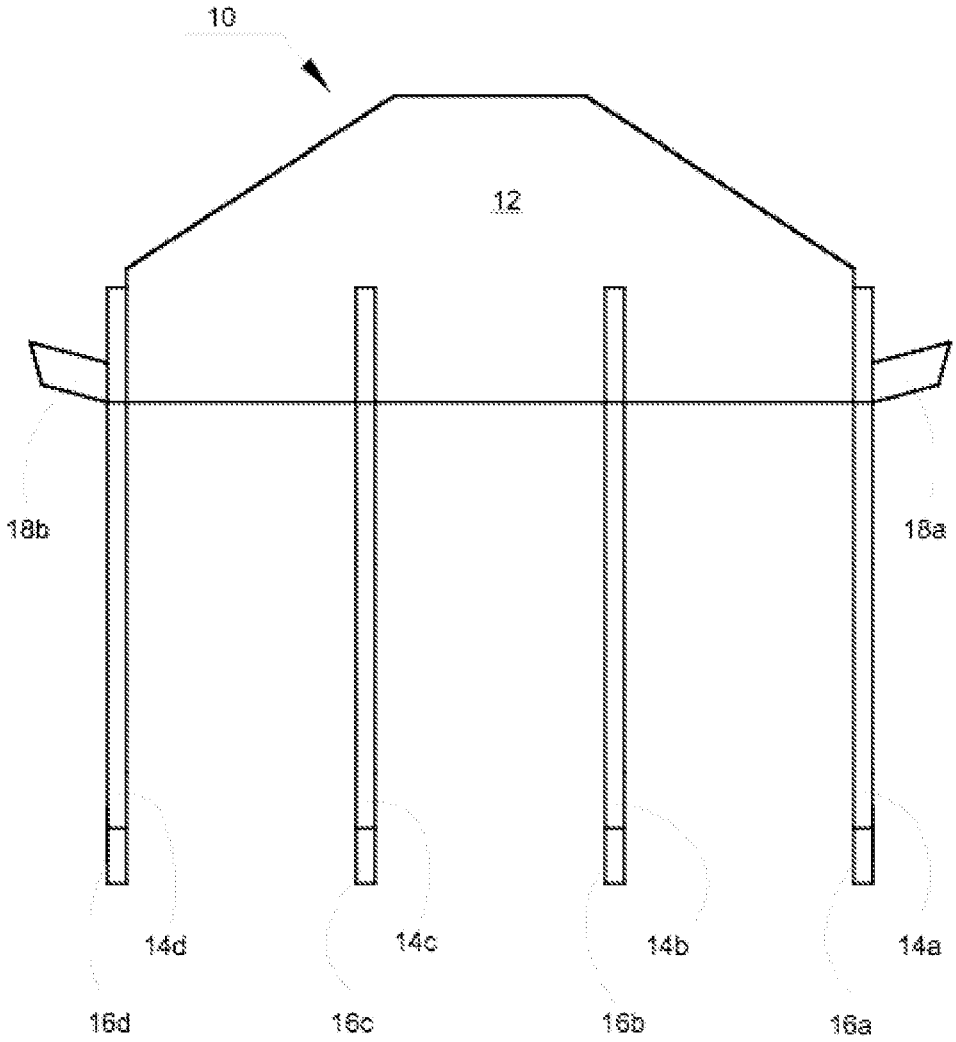
FIG. 6 is a plan view of the tool shown in FIG. 1.

FIG. 6 is a plan view of the tool 10 described in FIG. 1. This view shows that two barbs 18*a*, 18*b* can be provided, preferably on opposite sides of the head 12.

Figure 7:
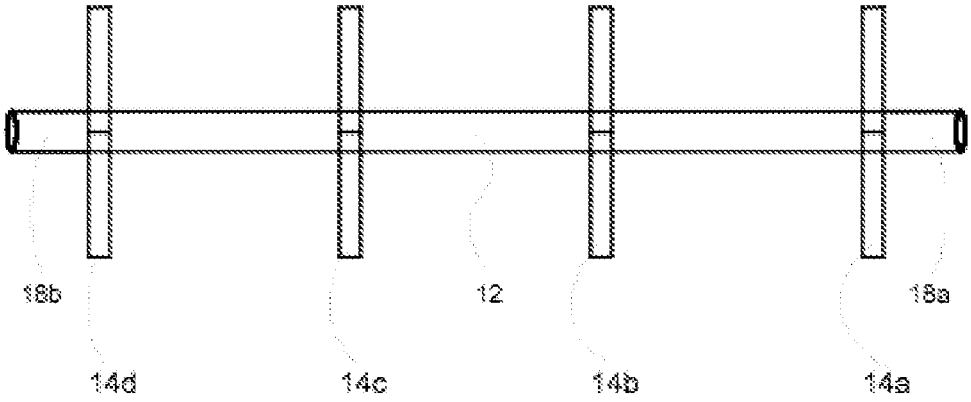
FIG. 7 is a front elevation of the tool shown in FIG. 1.

FIG. 7 is a front elevation showing more clearly that the head 12 can be planar, and the teeth 14*a*, 14*b*, 14*c*, 14*d* are arranged perpendicular to it. The teeth are set in a spaced relationship to each other and are parallel to each other. The teeth are also planar.

Figure 8:
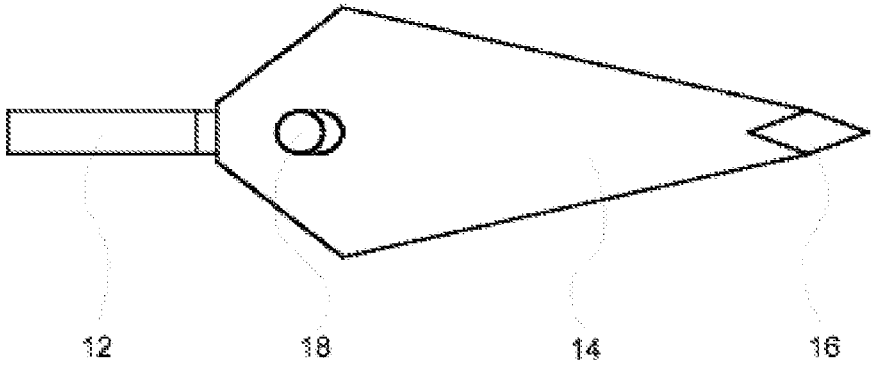
FIG. 8 is a side elevation of the tool shown in FIG. 1.

FIG. 8 is a side elevation. It shows the preferred arrowhead shape of the teeth 14, and position of the hardened tip 16, if provided.

Figure 9:
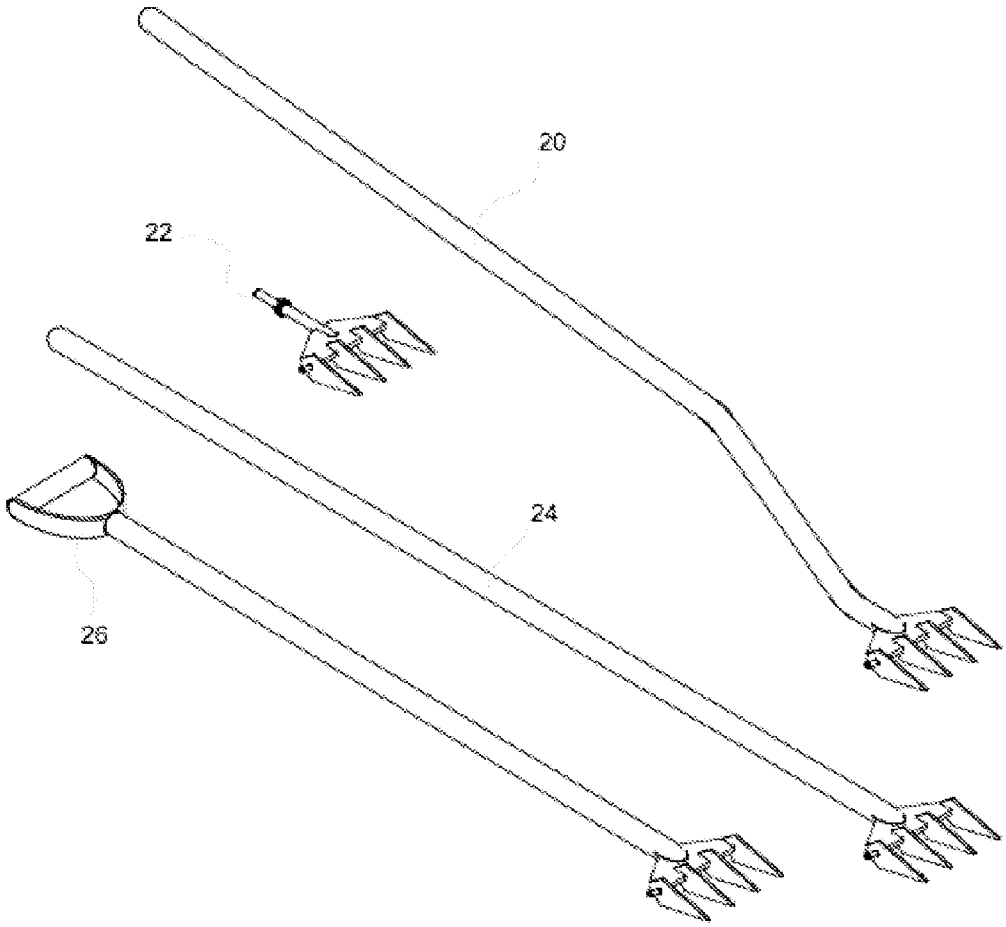
FIG. 9 is an orthogonal view of different handles and shanks that can be attached to the tool head.

FIG. 9 is an orthogonal view of the tool optionally secured to any of several different handles or shanks. It should be noted that handles could be coupled with the head at any desired angle, even though the drawings show them in line with the head and teeth. A standard recess can be provided in the head to accept shovel handles.

A back saver handle 20 has a long section for grasping that is offset from a shorter section that attaches to the head. A bit shank 22 can be coupled with the tool for attaching to a power hammer, air chisel, roto hammer, and the like. A straight shovel handle 24 can also be provided. Also, a D-grip 26 can be coupled to any handle to facilitate the use of the tool.

Figure 10:
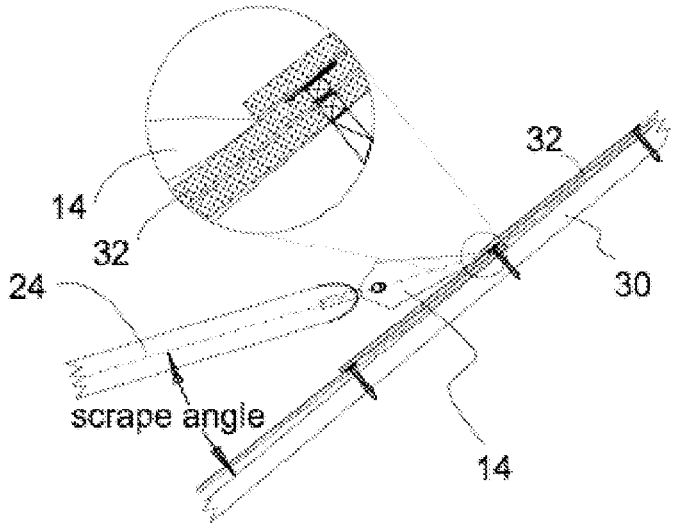
FIG. 10 is a view showing how the tool would be used in scraping shingles from a roof.
Figure 11:
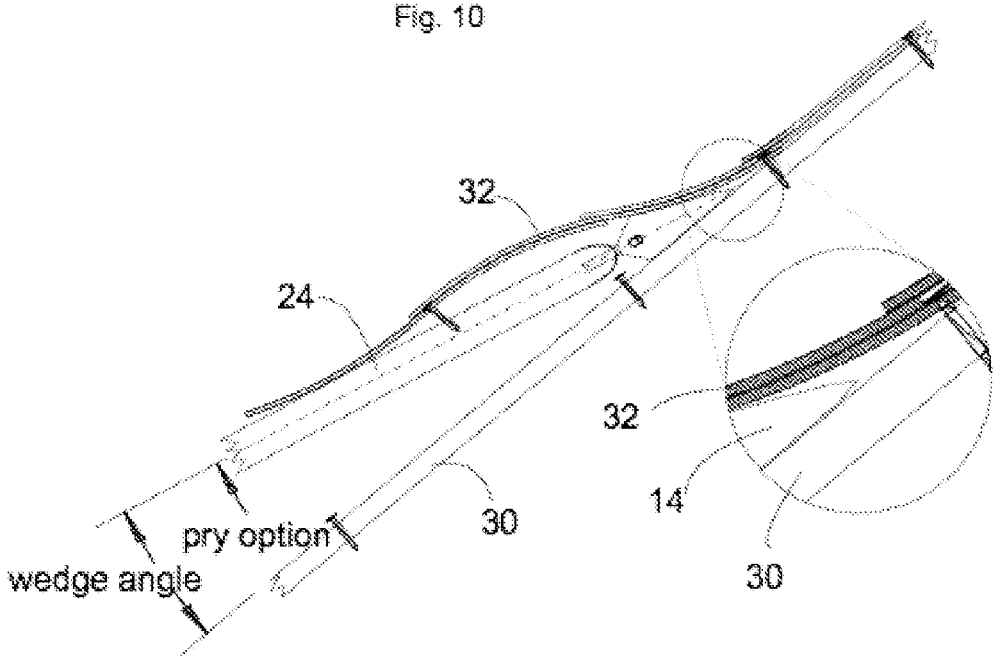
FIG. 11 is a view showing how the tool would be used in wedging and prying shingles from a roof.

FIG. 10 and FIG. 11 show the tool in operation loosening shingles 32 from a roof 30. The tool penetrates a gap in shingles 32 best by minimizing contact with the roof surface 30, shingles 32, and nails. The teeth 14 are thin and miss most of the nails.

This is a major advantage of the present invention over the serrated shovel of the prior art. The serrated shovel catches most of the nails, which slows down the operation. The present invention misses most of the nails while pulling up the shingles. This leaves the nails exposed. The user can then easily pull out the nails or drive them into the roof 30. After having penetrated beneath the shingles 32, the tool becomes a pry bar to loosen large sheets of material.

Figure 12:
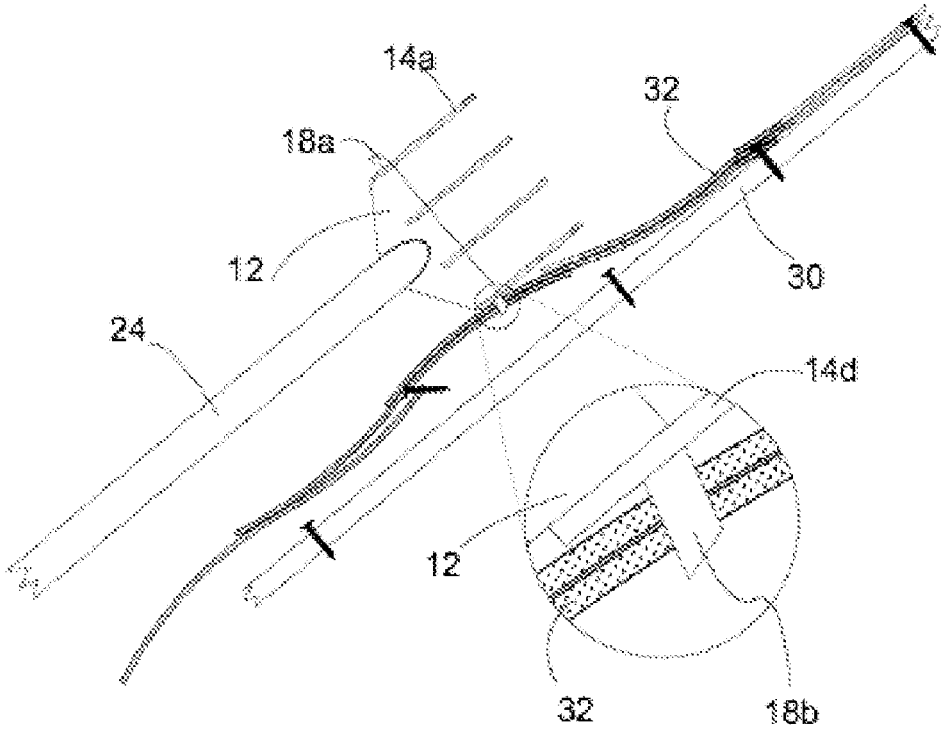
FIG. 12 is a view showing how a barb on the tool head is used to remove loosened shingles from a roof.

Turning to FIG. 12, it is known that loosened shingles will often be stuck to each other and the unloosened shingles 32. Barbs 18*a*, 18*b* are provided on the sides of the tool to grab and pull the material, thereby breaking chips free.

As material gets cleared from an area, the material tends to accumulate as chips of widely varying size in very heavy piles. This debris generally collects quickly and inhibits further clearing of the area. The tool of the present invention provides several effective means of moving the material towards the desired containment system and clear of the work area. Here are some examples:

1. Slide the tool under a chip or small pile, and heave the chip or small pile in the appropriate direction.
2. Turn the tool perpendicular to the roof deck and push the pile down slope.
3. Stab a chip with a barb, and then throw it.
4. Engage a chip between two teeth and then throw it.
5. Slide the tool under the pile and use it as lever to pry the pile down slope.
6. Throw the chip as it is sliding down the handle.

In operation, the tool is an apparatus that quickly detaches shingles from a roof or wall surface, and then acts as an effective debris-handling tool to move the debris efficiently to the ground. It exposes nails for easily pulling them out or pounding them in.

One of the advantages of the present invention is that, because of the teeth, it ignores nail removal to more rapidly and easily removes the heavy debris. It ignores the nail by not having tapered teeth. The shingle is quickly thrust over the head of the nail if the shingle does not pull up the nail right away. The nail does not stop the tool.

Another advantage is that, because of the barb and other features, it quickly detaches shingles from the roof surface and facilitates moving debris to the ground. The inventor has found that the present invention is three times faster than a serrated shovel at removing shingles from a roof.

Although the tool of the present invention is ideal for asphalt shingle removal, it can be used in other applications as well. For example, the tool can be used to effectively remove wooden shakes, clapboards, vinyl siding, luan floor underlayment, paneling, and sheetrock.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A shingle removal tool comprising:

a head;

a plurality of teeth coupled substantially perpendicular with the head, the teeth being in a spaced relationship parallel to each other, each tooth having an acute angle near an end of the tooth that is opposite the head for engaging shingles; and an elongated cylindrical protrusion terminating in an angled end thereby forming a barb, the barb coupled with the head, perpendicular to the plane of the teeth, and angled away from but not parallel to the ends of the teeth;

whereby a user can thrust the tool beneath a layer of shingles, the teeth lifting the shingles off a subsurface and free of nails, enabling the user to move the shingles away from the surface like a shovel to move the shingles away from the surface like a litter spike or to pierce the loosened shingles like to spike thus gaining purchase to move the same shingles away from the surface, and to also move shingles by using the barb.

2. The tool of claim 1, the teeth further comprising a hardened tip coupled with the acute angle end.

3. The tool of claim 2, wherein the hardened tip is a carbide tip.

4. The tool of claim 1, the head further comprising a handle-receiving recess at an end opposite the teeth.

5. The tool of claim 1, wherein the head is made of one selected from the group consisting of mild steel, carbon steel, alloy steel, tungsten, silicon carbide, titanium, and fiberglass.

6. The tool of claim 1, wherein the head is substantially planar, and the teeth are substantially identical to each other.

7. The tool of claim 1, wherein four teeth are coupled with the head.

8. The tool of claim 1, wherein the teeth are arrowhead-shaped.

9. The tool of claim 1, further comprising a handle coupled with the head.

10. The tool of claim 9, wherein the handle is a straight shovel handle.

11. The tool of claim 9, wherein the handle is a back saver shovel handle.

12. The tool of claim 9, further comprising a D grip coupled with the handle.

13. The tool of claim 9, the handle comprising a power hammer bit shank for attaching the tool to a power hammer.

14. An apparatus comprising:

a head;

four arrowhead-shaped teeth coupled with the head, the teeth being in a spaced relationship parallel to each other and substantially perpendicular to the head, each tooth having an acute angle near an end of the tooth that is opposite the head for engaging shingles; and an elongated cylindrical protrusion terminating in an angled end thereby forming a barb, the barb coupled with the head, perpendicular to the plane of the teeth, and angled away from but not parallel to the ends of the teeth;

whereby a user can thrust the tool beneath a layer of shingles, the teeth lifting the shingles off a subsurface and free of nails, enabling the user to move the shingles away from the surface like a shovel to move the shingles away from the surface like a litter spike or to pierce the loosened shingles like to spike thus gaining purchase to move the same shingles away from the surface, and to also move shingles by using the barb.

15. The apparatus of claim 14, wherein the head is substantially planar, and the teeth are substantially identical to each other.

16. The apparatus of claim 14, further comprising a handle coupled with the head.

17. The apparatus of claim 16, wherein the handle is a straight shovel handle.

18. The apparatus of claim 16, wherein the handle is a back saver shovel handle.

19. The apparatus of claim 16, further comprising a D grip coupled with the handle.

20. The tool of claim 16, the handle comprising a power hammer bit shank for attaching the tool to a power hammer.

* * * * *